US005978612A

United States Patent [19]

Suzuki et al.

[11] Patent Number: 5,978,612

[45] Date of Patent: Nov. 2, 1999

[54] IMAGE FORMING APPARATUS AND METHOD FOR MEASURING THE LENGTH OF A SHEET FED THERETHROUGH

[75] Inventors: Hidenobu Suzuki; Takashi Nakahara; Yasumasa Nashida; Tomoko Nanbu, all of Kawasaki, Japan

[73] Assignee: Canon Kabushiki Kaisha, Tokyo, Japan

[21] Appl. No.: 08/575,600

[22] Filed: Dec. 20, 1995

[30] Foreign Application Priority Data

Dec. 21, 1994 [JP] Japan ..... 6-318162

[51] Int. Cl.[6] ..... G03G 21/00

[52] U.S. Cl. ..... 399/16; 399/389

[58] Field of Search ..... 355/311, 208; 271/9.06, 265.01, 265.02; 399/16, 389

[56] References Cited

U.S. PATENT DOCUMENTS

| | | | |
|---|---|---|---|
| 4,675,696 | 6/1987 | Suzuki | 346/46 |
| 5,321,486 | 6/1994 | Nanbu et al. | 355/311 |
| 5,424,821 | 6/1995 | Sampath | 355/311 |

*Primary Examiner*—R. L. Moses

*Attorney, Agent, or Firm*—Fitzpatrick, Cella, Harper & Scinto

[57] ABSTRACT

In an apparatus which cannot detect a size of recording sheet before the recording sheet is fed, the first recording sheet is regarded as having the maximum size and paper feeding is controlled on this basis and the size of the sheet is measured during the conveyance of the recording sheet. For the second or third and subsequent recording sheets, paper feeding control is executed at a paper feeding interval at which a maximum throughput is obtained in accordance with the measured size.

6 Claims, 6 Drawing Sheets

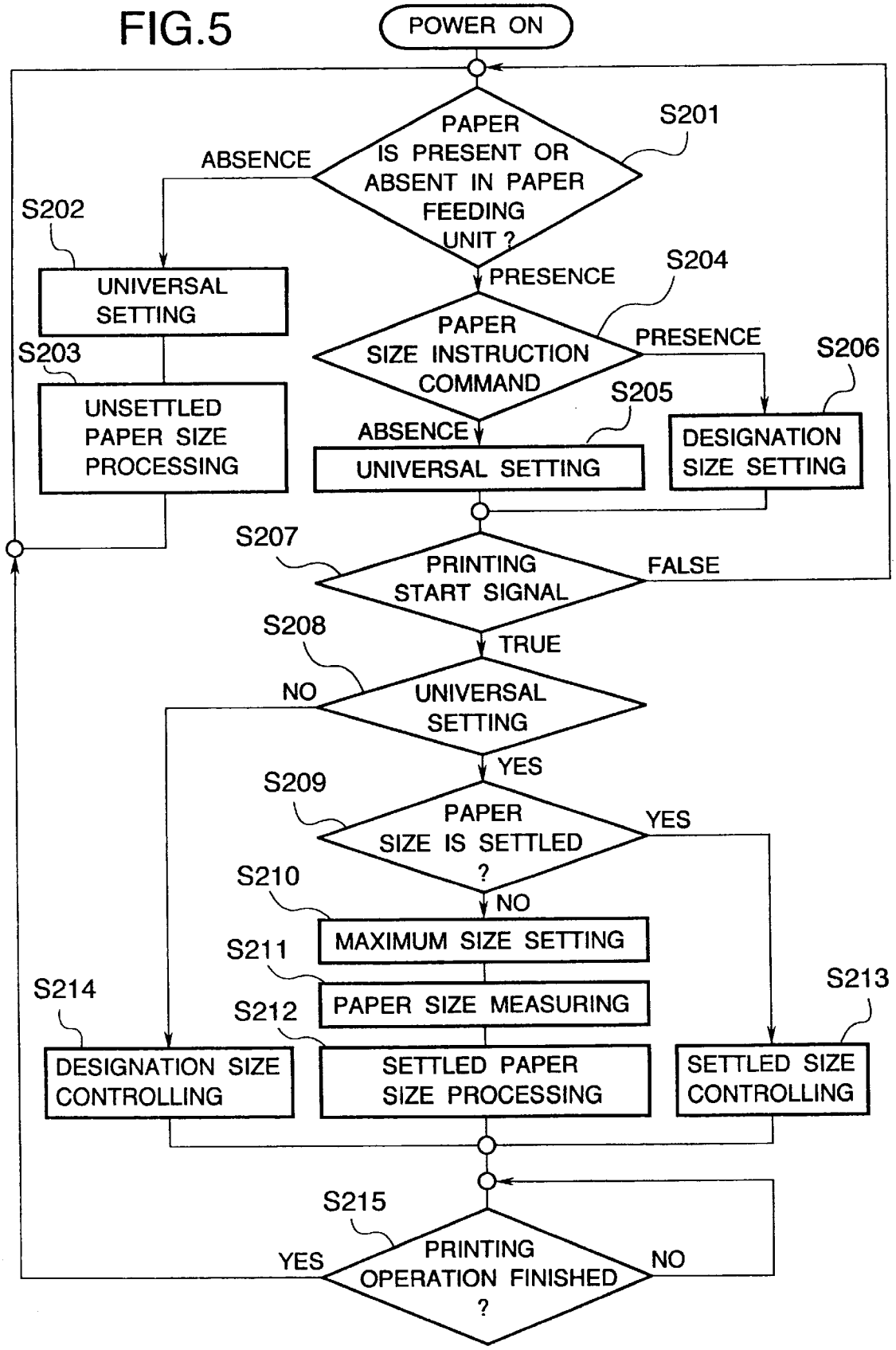
FIG.5
POWER ON
PAPER IS PRESENT OR ABSENT IN PAPER FEEDING UNIT ?
S201
ABSENCE
PRESENCE
S202
UNIVERSAL SETTING
S203
UNSETTLED PAPER SIZE PROCESSING
S204
PAPER SIZE INSTRUCTION COMMAND
PRESENCE
ABSENCE
S205
UNIVERSAL SETTING
S206
DESIGNATION SIZE SETTING
S207
PRINTING START SIGNAL
FALSE
TRUE
S208
UNIVERSAL SETTING
NO
YES
S209
PAPER SIZE IS SETTLED ?
YES
NO
S210
MAXIMUM SIZE SETTING
S211
PAPER SIZE MEASURING
S212
SETTLED PAPER SIZE PROCESSING
S213
SETTLED SIZE CONTROLLING
S214
DESIGNATION SIZE CONTROLLING
S215
PRINTING OPERATION FINISHED ?
YES
NO

IMAGE FORMING APPARATUS AND METHOD FOR MEASURING THE LENGTH OF A SHEET FED THERETHROUGH

BACKGROUND OF THE INVENTION

1. Field of the Invention

The invention relates to an image forming apparatus for detecting the size of recording sheet.

2. Related Background Art

Hitherto, for example, in a printer which cannot detect accurate size information of a recording sheet before it is fed, the distance to recording sheet detecting means is long and in order to realize a maximum throughput, the recording sheet detecting means has to execute the next paper feeding operation before detecting a rear edge of the recording sheet which was fed in advance. In a image forming apparatus with such a construction, paper size data and image data are received from an external computer and the image data is developed and, after completion of the development, the paper size data represents a universal setting and is sent to a printer engine and a printing start signal is transmitted. When receiving the printing start signal, the printer engine controls continuous paper feeding at a paper feeding timing which presumes a recording sheet of the maximum size which can be conveyed so as not to cause inconveniences such as image drop-out, jamming, and the like even in all of the paper sizes of specific lengths which can be conveyed by the image forming apparatus. The "universal setting" denotes that an arbitrary size which is equal to or less than the maximum paper size which can be conveyed and which is specified by the image forming apparatus is set.

However, there are the following problems in an image forming apparatus of a construction such that the size of papers stacked in a paper feeding unit cannot be detected before feeding the paper and a distance from the paper feeding unit to a recording sheet detecting means is long.

(1) In case of performing the universal setting, even if the paper size is small, since the continuous paper feeding operation is always performed at a paper feeding timing based on the maximum size, the throughput is not raised.

(2) In case of performing the universal setting, even if the paper size is small, since the continuous paper feeding operation is always executed at a paper feeding timing based on the maximum size, a time during which the apparatus operates is longer than it is needed, so that the life of apparatus or its reliability deteriorates.

(3) Each time the user tries to obtain the maximum throughput suitable for the paper size, the paper size has to be set from the external computer or the like.

SUMMARY OF THE INVENTION

It is an object of the invention to provide an image forming apparatus which can eliminate the foregoing drawbacks.

Another object of the invention is to provide an image forming apparatus which can improve a throughput irrespective of the size of recording sheet even in an apparatus with a construction such that the size of recording sheet cannot be detected before feeding the paper.

Still another object of the invention is to provide an image forming apparatus which can perform a conveyance control suitable for the size of a recording sheet even if there is no size instruction of the recording sheet from the outside in an apparatus with a construction which cannot detect the size of the recording sheet before feeding the paper.

The above and other objects and features of the present invention will become apparent from the following detailed description and the appended claims with reference to the accompanying drawings.

BRIEF DESCRIPTION OF THE DRAWINGS

FIG. 5 is an operation flowchart of the printer engine; and

DETAILED DESCRIPTION OF THE PREFERRED EMBODIMENT

An embodiment of the invention will now be described in detail hereinbelow with reference to the drawings.

Figure 1:
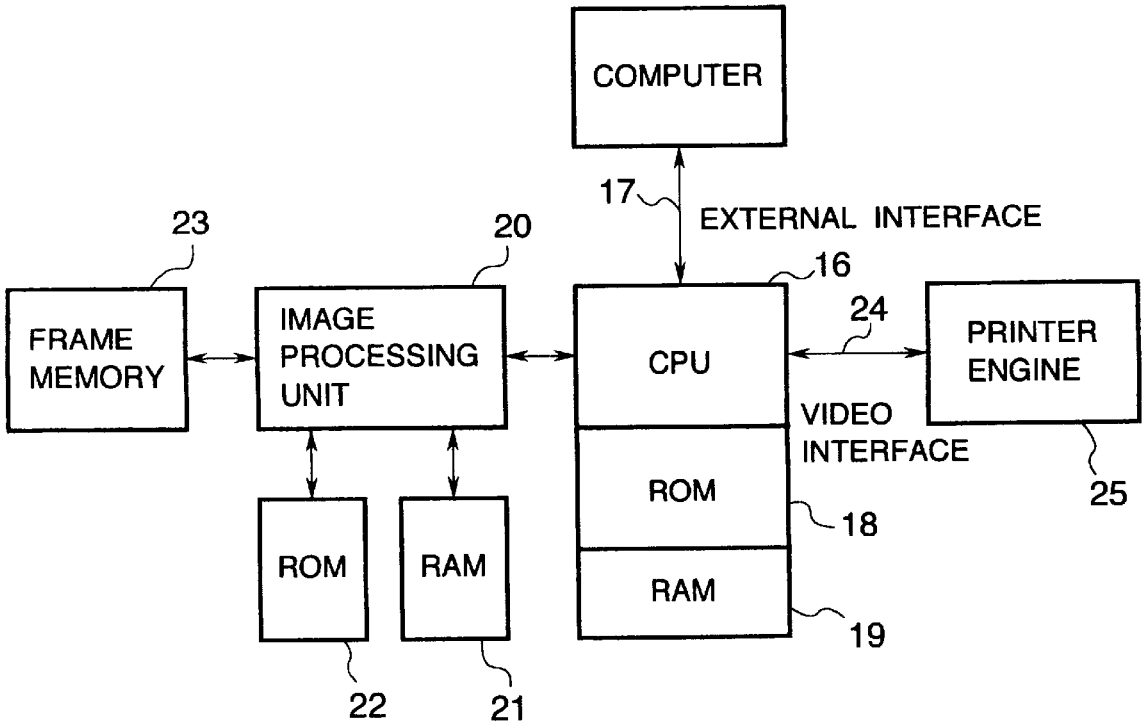
FIG. 1 is a block diagram of the construction of a video control according to the invention.

FIG. 1 is a block diagram of a construction for executing a data process of a printer according to the invention. In the diagram, reference numeral 16 denotes a CPU; 18 denotes an ROM in which control programs including a control program shown in FIG. 4 have been stored; 19 denotes an RAM which is used as a register or the like; and 17 denotes an external interface for receiving coded image information (code data) from a host computer or the like. The received code data is transmitted to an image processing unit 20 by the CPU 16. The image processing unit 20 stores the code data into an RAM 21, analyzes the code data, reads out data from character fonts stored in an ROM 22 as necessary, converts the code data into video data of a dot image, and stores the video data in a frame memory 23. When the video data of one page is stored in the frame memory 23, the CPU 16 transmits a printing command to a control unit of a printer engine 25 through a video interface 24. The CPU 16 sequentially transmits the video data stored in the frame memory 23 to the control unit of the printer engine 25 synchronously with main and sub scanning sync signals from the control unit of the printer engine 25. The main scanning direction is the direction perpendicular to the conveying direction of a paper. The sub scanning direction is the conveying direction of the paper.

Figure 3:
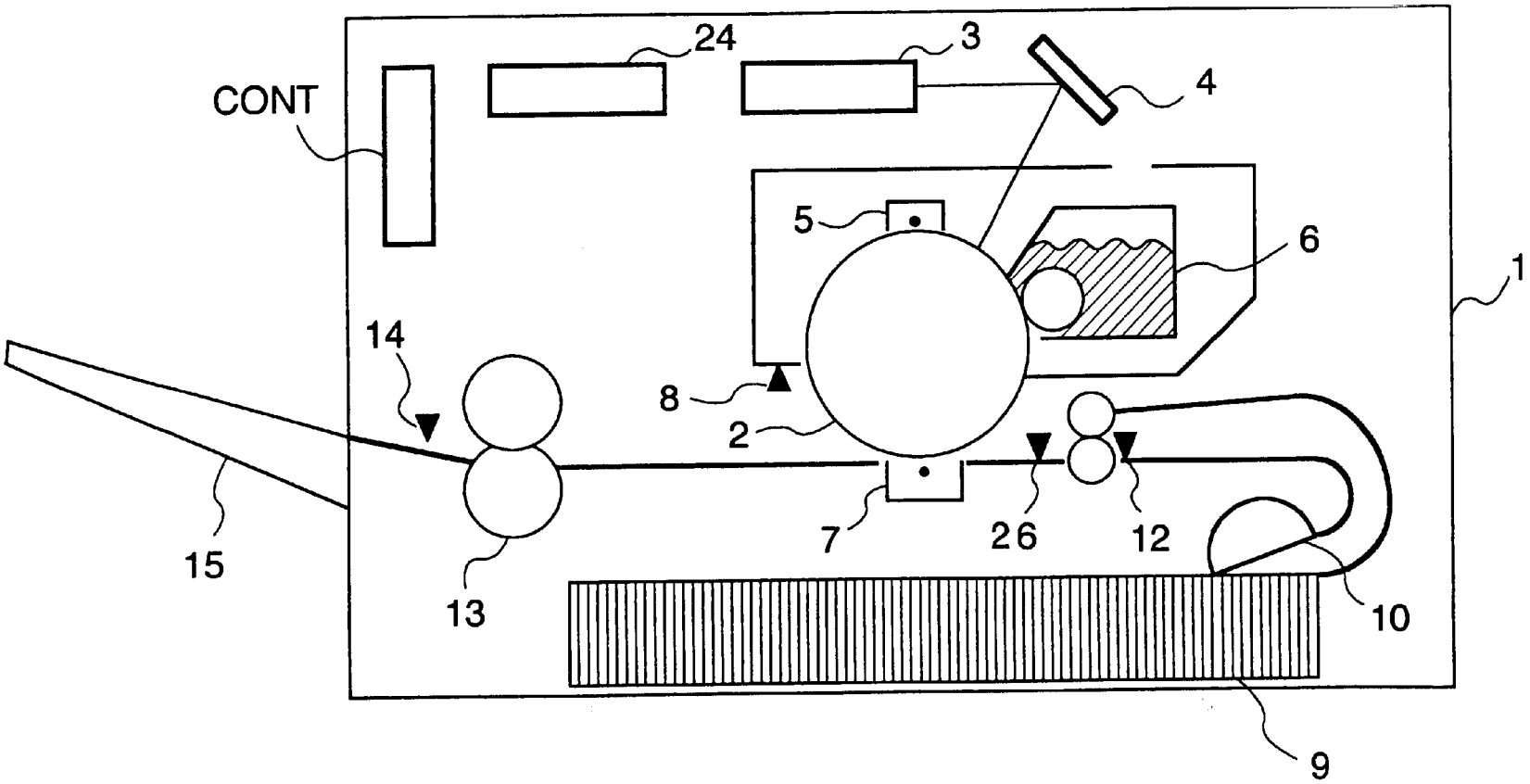
FIG. 3 is an explanatory diagram of the structure of a printer engine according to the invention.

FIG. 3 shows a structure of the printer engine. In FIG. 3, the same component elements as those shown in FIG. 1 are designated by the same reference numerals. Reference numeral 1 denotes a printer main body. In the embodiment, a case of a laser beam printer is shown. A controller CONT is constructed by the component elements 16 to 24 and the like in FIG. 1. Reference numeral 3 denotes an optical unit for modulating a laser beam by the video data sent from the controller CONT via the video interface 24, generating the laser beam, which is reflected by a return mirror 4 irradiate a photosensitive drum 2. In the optical unit 3, by irradiating a polygon-shaped mirror, the laser beam scans the photosensitive drum 2 in the main scanning direction. Reference numeral 5 denotes a charging unit for uniformly charging the photosensitive drum 2; 6 denotes a developing unit for developing an electrostatic latent image on the photosensitive drum 2 to a toner image; 7 denotes a transfer unit for transferring the toner image on the photosensitive drum 2 onto a recording paper; 8 denotes a cleaner for collecting a toner remaining on the photosensitive drum 2 after the latent image was transferred thereon; 9 denotes a sheet cassette; 10 a paper feeding roller for feeding sheets stacked in the sheet cassette 9; 12 denotes a paper feeding sensor for detecting the presence or absence of the paper which was fed; 13 denotes a fixing unit for fixing the toner image transferred to the paper onto the paper by heating and pressurizing; 14 denotes a paper ejecting sensor for detecting the presence or absence of the paper ejected out from the fixing unit 13; 15 denotes a paper ejecting tray; 26 denotes a top sensor for transmitting a sub scanning sync signal to inform a timing to start the printing for the conveyed and fed paper to the controller CONT.

Figure 4:
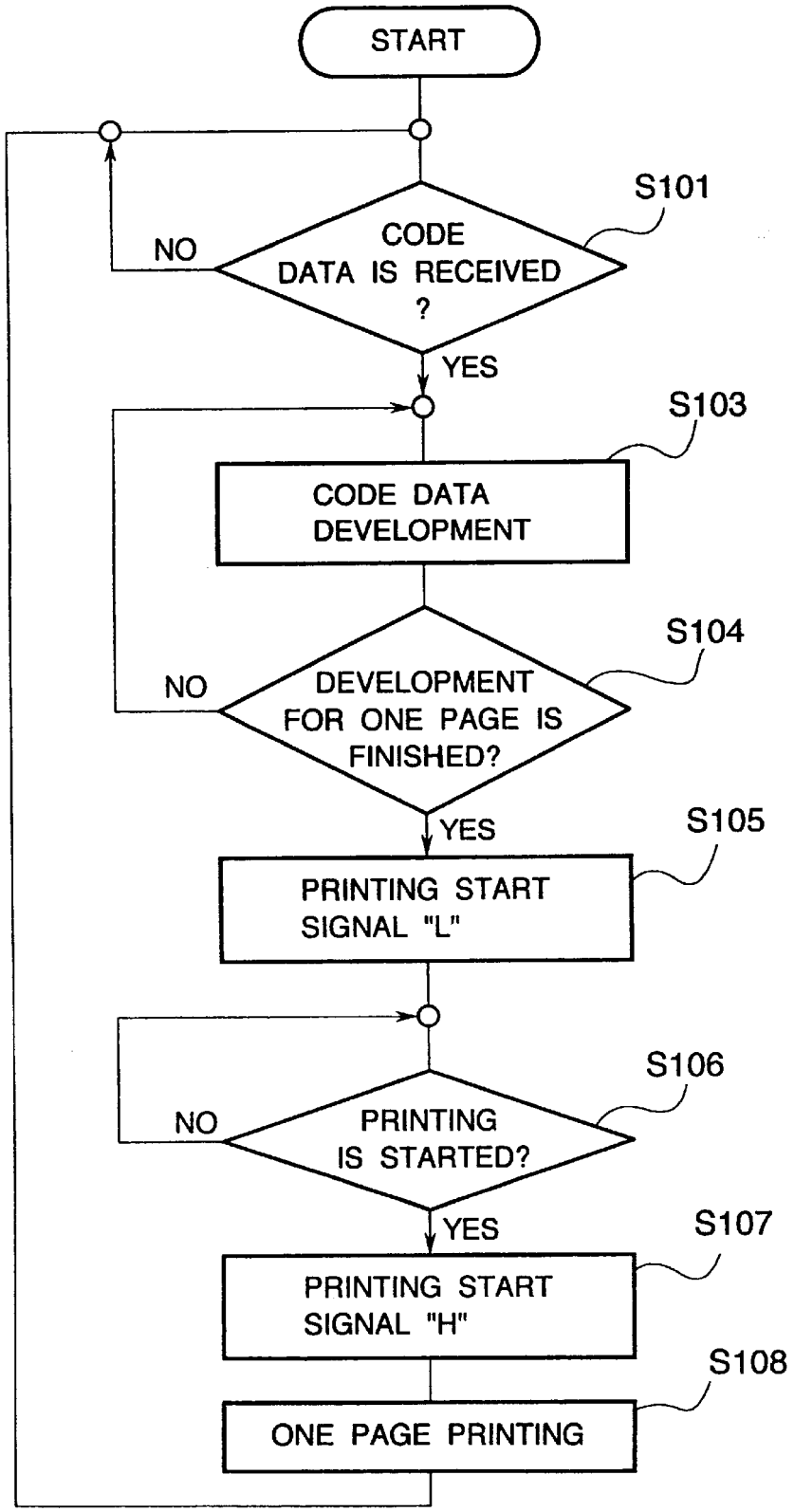
FIG. 4 is an operation flowchart of a video controller unit.

FIG. 4 is a flowchart showing the operation of the controller CONT. FIG. 5 is a flowchart showing the operation of the printer engine. The printing operation of the invention will now be described with reference to the drawings.

In step S101, the controller waits until the code data of an image is transmitted from an external apparatus, such as a host computer or the like. When the code data is received, the processing routine advances to step S103. In step S103, the code data is decoded in the image processing unit 20 and is developed to the video data for the frame memory 23. In step S104, a check is made to see if the development from the code data of one page to the video data has been finished. If NO, the processing routine is returned to step S103. If YES, step S105 follows. In step S105, in order to instruct the printer engine to start the printing, a printing start signal of the video interface 24 is set to the "L" level. By receiving the printing start signal, the printer engine starts the paper feeding operation to start the printing operation, the driving of a polygon motor is started, and pre-processes, such that the surface of the photosensitive drum 2 is uniformly charged and the like, are executed. The controller waits until a sub scanning sync signal is transmitted through the video interface 24. When the sub scanning sync signal is received, step S107, the printing start signal is set to the "H" level. The video data from the frame memory 23 is transmitted to the printer engine 25 in step S108. The data of one page is printed. The processing routine advances to step S101.

Figure 2:
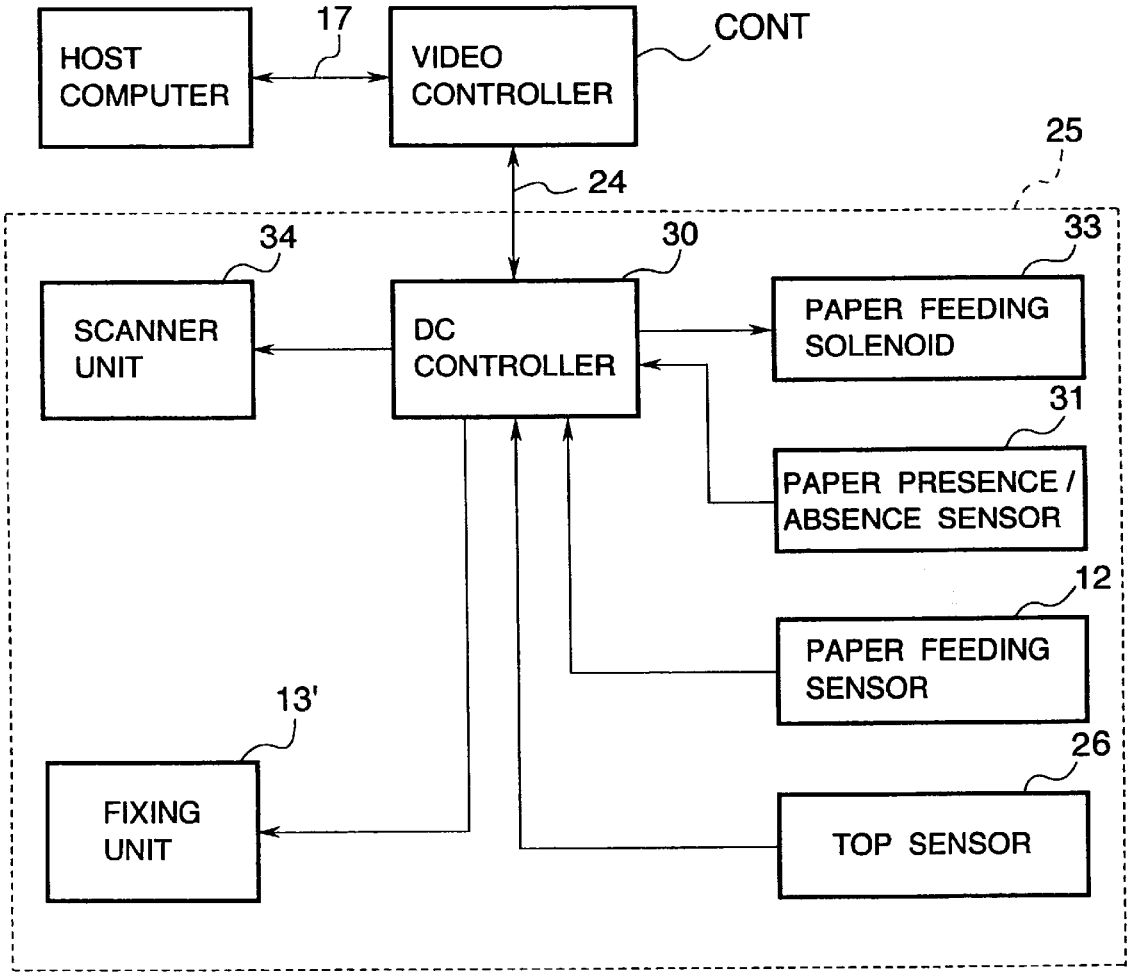
FIG. 2 is a block diagram of a control unit of a printer engine according to the invention.

FIG. 2 shows the electrical construction of the printer engine of the invention. A DC controller 30 executes all of a sequence control, a process control, and a printing control of the engine. The DC controller 30 can be constructed by, for example, an MPU (microprocessor unit). The DC controller, further, has memory means having a storage area of a control program shown in FIG. 5, a work area to transmit and receive data or the like when executing the control, and the like. FIG. 2 shows a construction, as an example, such that the DC controller 30 receives signals from a paper presence/absence sensor 31 to detect the presence or absence of the paper in the cassette, the paper feeding sensor 12, and top (TOP) sensor 26, and drives a paper feeding solenoid 33 for feeding the paper in the cassette, a scanner unit 34 including the optical unit, polygon, mirror, and the like, and a fixing unit 13'. The DC controller 30 is connected to the video controller CONT through the video interface 24 and controls the transmission and reception of the printing start signal or the like by the interface 24. The operation of the printer engine 25 in case of constructing the DC controller 30 by an MPU will now be described with reference to FIG. 5.

When a power supply is turned on, the DC controller 30 executes an internal initial setting and monitors the signal from the paper presence/absence sensor 31 in step S201. When the paper is absent, step S202 follows. When the paper exists, step S204 follows. In step S202, the present paper size setting in the printer engine is forceably changed to the universal setting. In step S203, processing is performed as an unsettled paper size state in the universal setting. After that, the processing routine is again returned to step S201 and the presence or absence of the paper in the paper feeding unit is monitored. In step S204, the apparatus waits for a paper size instruction command which is transmitted from the video controller CONT through the video interface 24. When there is a command transmission, step S206 follows. When there is no command transmission, step S205 follows. In step S205, the paper size setting in the printer engine is changed to the universal setting. In step S206, the paper size setting in the DC controller is changed to a designation size setting instructed by a command. Step S207 follows.

In step S207, the apparatus waits for the printing start signal which is transmitted from the video controller CONT through the video interface 24. When the signal is false, step S201 follows and the presence or absence of the paper in the paper feeding unit is monitored. When the signal is true, step S208 follows. In step S208, the present paper size setting is monitored. When it is not the universal setting, step S214 follows. When it is the universal setting, step S209 follows. In step S214, the printing operation is set on the basis of the designation size set in step S206, thereby controlling at a continuous paper feeding timing such as to obtain the maximum throughput at the designated size.

In step S209, a settled paper size state in the universal setting is monitored. If the paper size has already been settled, step S213 follows and control is performed at the continuous paper feeding timing so as to obtain the maximum throughput at the universal setting size. When the paper size is not settled yet, step S210 follows and the control is executed at the continuous paper feeding timing so as to obtain the maximum throughput at the maximum paper size. After that, the paper is fed from the sheet cassette. In step S211, a length of printing paper is measured by the signal from the paper feeding sensor 12. Namely, since the front edge of the printing paper reaches the paper feeding sensor 12, the sensor output signal changes to a paper presence state. At this time, a printing paper length measuring timer in the MPU in the DC controller 30 is started. Since the paper rear edge of the printing paper passes through the paper feeding sensor 12, the sensor output signal changes to a paper absent state. At this timing, the printing paper length measuring timer is held. In step S212, the size of printing paper is judged by the data from the printing paper length measuring timer. The state is set to the settled paper size state in the universal setting. Size data judged by the printing paper length measuring timer is set to the settled size in the universal setting. The printing operation is executed on the basis of the data set in steps S212, S213, and S214. In step S215, a check is made to see if the printing operation of the data of one page has been finished. If YES, step S201 follows and the presence or absence of the paper in the paper feeding unit is monitored.

Figure 6:
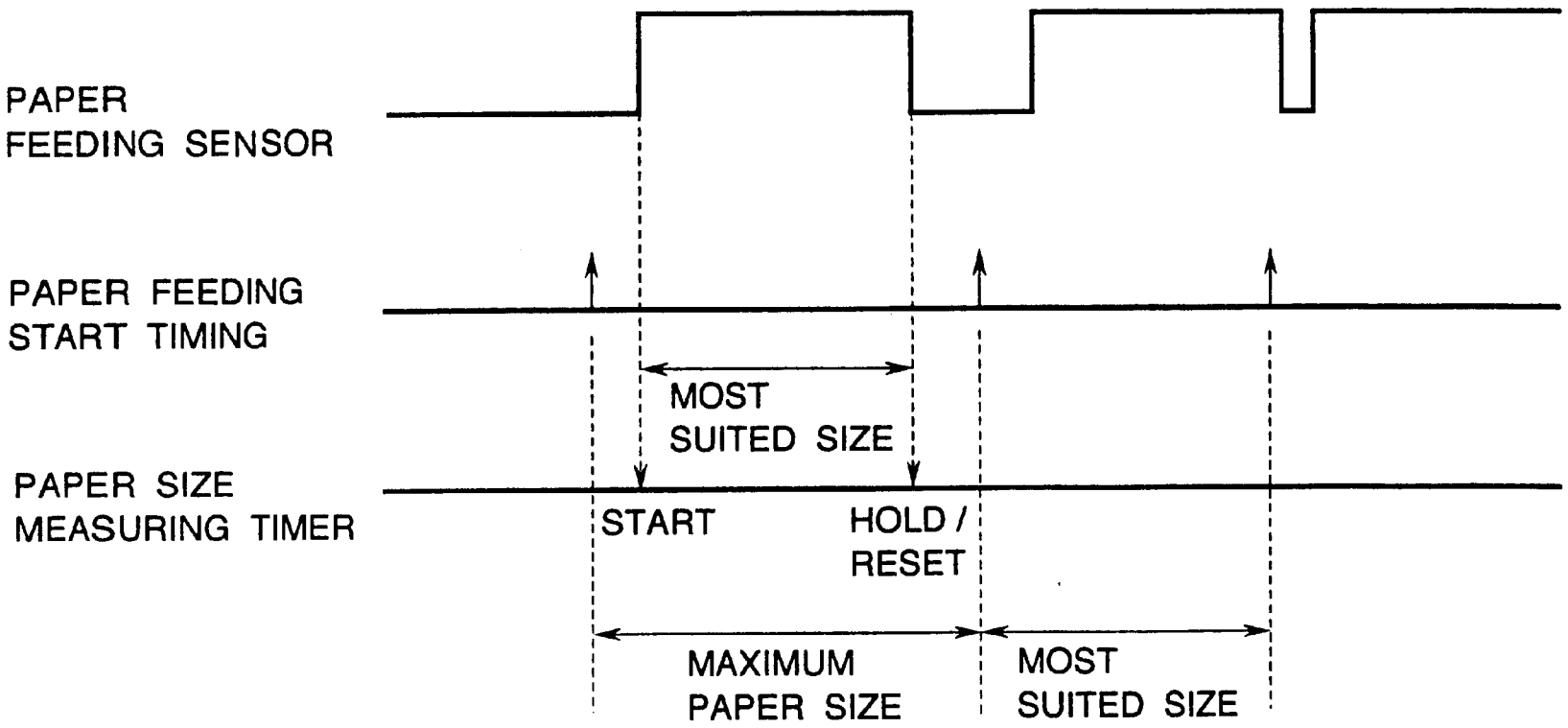
FIG. 6 is a timing chart for the printing operation.

Therefore, with respect to the third and subsequent recording papers, the paper feeding timing is controlled on the basis of the size settled in the recording operation of the first paper. FIG. 6 shows the timing of the paper feeding sensor, the paper feeding start timing, and the timing between the paper size measuring timers including the paper feeding sensor in steps S210 to S215.

When the size of recording paper is settled before the second recording paper is fed, it is sufficient to feed the second recording paper at the optimum timing according to the settled size.

As described above, even in the case where the size of papers stacked in the paper feeding unit cannot be previously detected, a paper feeding control suitable for the size of paper to be fed can be performed. Therefore, in case of a small paper size, the throughput is raised. Since the apparatus operates for only a necessary time, not only the life and reliability of the apparatus can be improved but also an energy saving can be realized. According to the invention, the maximum throughput can be realized without needing to set the paper size from an external apparatus.

The present invention is not limited to the foregoing embodiment but many modifications and variations are possible within the spirit and scope of the appended claims of the invention.

What is claimed is:

1. An image forming apparatus comprising:

enclosing means for enclosing a plurality of sheets;

conveying means for conveying the sheets enclosed in said enclosing means;

a sensor for detecting a first sheet which is conveyed by said conveying means;

measuring means for measuring the length of the first sheet on the basis of an output of said sensor;

command receiving means for receiving a command representing the size of a sheet to be used in said apparatus from an external device; and control means for, when the command is not received by said command receiving means, controlling said conveying means, on the basis of a maximum size which can be conveyed by said conveying means, to convey the first sheet, which is conveyed in said enclosing means before completion of the measurement of the length of the first sheet by said measuring means, for controlling said conveying means, on the basis of the length of the first sheet which has already been measured by said measuring means, to convey a subsequent sheet which is conveyed after completion of the measurement by said measuring means, and for controlling said conveying means on the basis of the size of the sheet represented by the received command when the command is received by said command receiving means.

2. An apparatus according to claim 1, wherein said control means controls a conveying timing of the sheet.

3. An apparatus according to claim 2, wherein said control means controls said conveying means so as to sequentially convey said plurality of sheets at a conveying timing at which the throughput of an image forming operation becomes a maximum.

4. An image forming method comprising steps of:

awaiting receipt of a command representing the size of a sheet to be used in an image forming apparatus, from an external device with command receiving means;

conveying sheets enclosed in enclosing means of the image forming apparatus;

measuring the length of a first sheet conveyed in said conveying step on the basis of an output of a sheet detecting sensor when the command awaited in said awaiting step is not received; and controlling conveyance of the first sheet on the basis of a maximum size which can be conveyed in said conveying step for the first sheet which is conveyed in the enclosing means before completion of the measurement of the length of the first sheet in said measuring step when the command awaited in said awaiting step is not received, controlling the conveyance of a subsequent sheet in said conveying step on the basis of the length of the first sheet which has already been measured in said measuring step, the subsequent sheet being conveyed after completion of the measurement in said measuring step, and controlling the conveyance of the first sheet on the basis of the size of the sheet represented by the command when the command awaited in said awaiting step is received by the command receiving means.

5. A method according to claim 4, wherein said controlling step comprises the step controlling the conveying timing of the sheets.

6. A method according to claim 4, wherein said controlling step controls the conveyance of the sheets so as to sequentially convey a plurality of sheets at a conveying timing at which the throughput of the image forming operation becomes a maximum.

* * * * *

UNITED STATES PATENT AND TRADEMARK OFFICE

CERTIFICATE OF CORRECTION

PATENT NO. : 5,978,612

DATED : November 2, 1999

INVENTOR(S): HIDENOBU SUZUKI, ET AL.

It is certified that error appears in the above-identified patent and that said Letters Patent is hereby corrected as shown below:

Title page,

AT [57] ABSTRACT

Line 1, "of" should read --of a--.

COLUMN 1

Line 17, "a" should read --an--.

COLUMN 2

Line 56, "irradiate" should read --to irradiate--; and
Line 67, "10" should read --10 denotes--.

UNITED STATES PATENT AND TRADEMARK OFFICE

CERTIFICATE OF CORRECTION

PATENT NO. : 5,978,612

DATED : November 2, 1999

INVENTOR(S): HIDENOBU SUZUKI, ET AL.

It is certified that error appears in the above-identified patent and that said Letters Patent is hereby corrected as shown below:

COLUMN 6

Line 8, "steps" should read --the steps--.

Signed and Sealed this

Fifth Day of December, 2000

*Attest:*

*Attesting Officer*

Q. TODD DICKINSON

*Director of Patents and Trademarks*